United States Patent [19]

Seal

[11] 4,320,988

[45] Mar. 23, 1982

[54] SPREADER/GRADER

[76] Inventor: James C. Seal, Rte. 1, Box 350, Picayune, Miss. 39466

[21] Appl. No.: 182,392

[22] Filed: Aug. 26, 1980

[51] Int. Cl.[3] ..... E01C 19/22

[52] U.S. Cl. ..... 404/118; 172/393

[58] Field of Search ..... 404/118, 106, 120; 172/393

[56] References Cited

U.S. PATENT DOCUMENTS

| | | | |
|---|---|---|---|
| 1,068,155 | 7/1913 | Mosher | 172/393 X |
| 1,303,415 | 5/1919 | Thurston | 404/118 X |
| 1,368,585 | 2/1921 | Vigil | 172/393 |
| 1,487,723 | 3/1924 | Corbitt | 172/393 |
| 1,851,064 | 3/1932 | Reifschneider | 172/393 |
| 2,192,254 | 3/1940 | Beadle | 404/118 |
| 2,994,142 | 8/1961 | Newell | 172/393 |
| 3,015,258 | 1/1962 | Apel | 404/106 |
| 3,373,799 | 4/1968 | Conley | 172/393 |
| 3,901,618 | 8/1975 | Sant'Agata | 404/118 |

*Primary Examiner*—Nile C. Byers, Jr.

*Attorney, Agent, or Firm*—Harvey B. Jacobson

[57] ABSTRACT

A spreader/grader is attachable to a three-point hitch associated with a tractor and includes a pair of curved cutting blades which are adjustable so as to control cutting depth. The cutting blades are mounted between a pair of side runners and include curved cutting edges to facilitate spreading or grading operations. The positioning of the blades is variable both with respect to cutting depth and to angular orientation with the surface being graded through the use of hydraulic ram adjustment mechanisms provided at respective ends of the blades. Both blades may be attached to the spreader/grader so as to present cutting edges directed in the same direction and their respective cutting depths may be varied from each other through the use of the hydraulic ram adjustment mechanisms, or alternatively, one or both of the blades may be positioned with their cutting edges reversely directed from the direction of forward movement of the pulling tractor so as to provide a grading or feathering operation.

5 Claims, 7 Drawing Figures

10
12
14
16
18
20
22
24
26
28
30
32
34
36
38
40
42
44
46
48
50
52
54
56
58
60
62
64
66
68
70
72
74
76
78
80
82
88
94

10
14
32
34
84
86
88
90
92

10
32
34
84
86
88
90
92
94

SPREADER/GRADER

BACKGROUND OF THE INVENTION

1. Field of the Invention

The present invention relates to a spreader/grader designed to be pulled by a motor vehicle such as a tractor and more particularly pertains to a spreader/grader which utilizes cutting blades that are variable in cutting depth and in angular relationship to a surface being cut through the use of hydraulic adjustment means.

2. Description of the Prior Art

With respect to the development of spreader/graders utilizable with farm tractors, there has long been recognized a need for developing a spreader/grader which has multi-positionable cutting blades and which may be economically and easily manufactured. An early attempt to develop such a spreader/grader is to be found in U.S. Pat. No. 1,487,723, issued Mar. 25, 1924, to Corbitt, wherein there is disclosed a land leveler which may be pulled by a motor vehicle and which has a pair of side runners held together by bracing bars. An arcuate cutting blade is mounted on a rotatable shaft positioned between the side runners, such blade being adjustable to a desired cutting angle by rotating the same about the shaft through the use of a manually operated lever fixedly attached to the shaft. The Corbitt device utilizes but one blade which is adjustable in cutting depth and which is not adjustable at ends thereof with respect to the side rails so as to vary the angular relationship between the blade and the surface being levelled. As such, the Corbitt land leveler is representative of prior art spreader/graders which are severely limited in their flexibility relating to cutting a surface at a desired depth and angle.

SUMMARY OF THE INVENTION

The general purpose of the present invention is to provide a spreader/grader that has all of the advantages of similarly employed prior art spreader/graders and has none of the above described disadvantages. To attain this, the present invention provides for a spreader/grader that is attachable to a three-point hitch of a tractor and which utilizes a plurality of cutting blades adjustable both in depth and angular position. In this respect, the spreader/grader is comprised of a pair of side runners fixedly attached together through the use of support members and having at least two curved cutting blades positioned therebetween. The curved cutting blades are attachable to the respective side runners in a manner which will present a curved cutting edge in a direction of towing by the tractor, or alternatively, the curved cutting edges may be reversely directed so as to provide for a grading or feathering operation in the direction of the tow. If desired, one blade may be positioned for a forward cutting action while the other blade may be reversely positioned for a grading action. The blades are independently adjustable with respect to each other through the use of hydraulic ram adjustment mechanisms which are attached to each of the blades at respective ends thereof. Through the use of these hydraulic ram adjustment mechanisms, the blades may be rotated so as to vary their cutting depths and, if desired, the blades may be independently set at different cutting depths. Further, the respective ends of the blades may be positioned at different cutting depths from each other so as to vary the angle of a cut on a surface. Additionally, the hydraulic ram adjustment mechanisms may themselves be mounted in a plurality of different angular relationships with respect to the side runners so as to provide for even further angle and depth adjustment of the blades.

It is therefore an object of the present invention to provide a new and improved device for spreading and grading operations on a surface.

It is a further object of the present invention to provide a new spreader/grader which utilizes a plurality of independently adjustable cutting blades.

It is still another object of the present invention to provide a new and improved spreader/grader which is attachable to a three-point hitch associated with a farm tractor.

It is yet another object of the present invention to provide a spreader/grader utilizing a plurality of arcuate cutting blades which may be reversed in direction.

It is even another object of the present invention to provide a spreader/grader that utilizes adjustable cutting blades which may be independently adjusted to different cutting depths.

An even further object of the present invention is to provide a spreader/grader which utilizes a plurality of hydraulic ram adjustment mechanisms to independently adjust cutting blades associated therewith.

A still further object of the present invention is to provide a spreader/grader utilizing cutting blades which may be independently adjusted in depth as well as angularly positioned with respect to a surface to be cut.

Yet even another object of the present invention is to provide a spreader/grader which is lightweight and durable in construction.

Still even another object of the present invention is to provide a spreader/grader that may be economically and easily manufactured.

Even another object of the present invention is to provide a spreader/grader which has all of the advantages of the prior art spreader/graders and none of the disadvantages.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
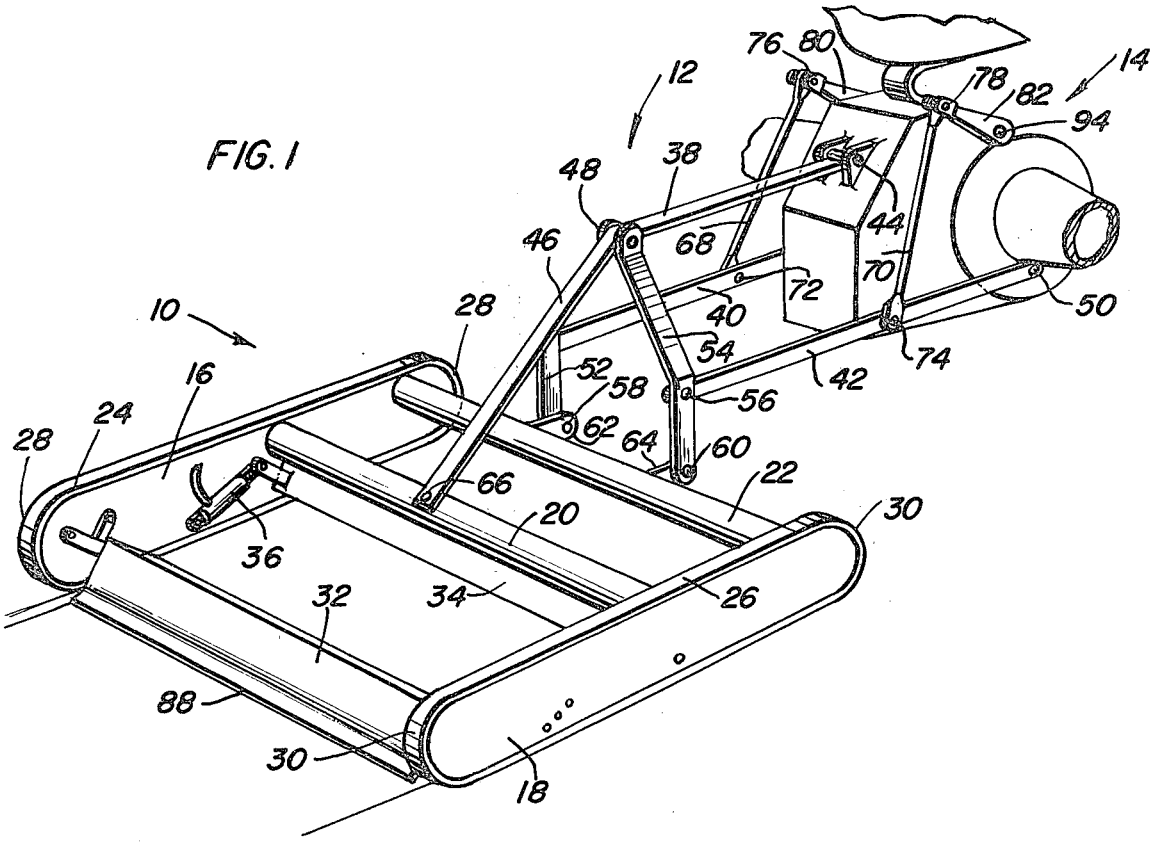
FIG. 1 is a perspective view of a preferred embodiment of the spreader/grader forming the present invention.

Referring now to the drawings and, in particular, to FIG. 1 wherein there is illustrated in detail a preferred embodiment of the spreader/grader comprising the present invention and generally designated by the reference numeral 10. In this respect, the spreader/grader 10 is shown connected to a three-point hitch 12 associated with a tractor 14. The spreader/grader 10 comprises a pair of paralleledly aligned spaced-apart side runners 16, 18 which are fixedly attached to each other through the use of a pair of support members 20, 22. In the embodiment illustrated, the support members 20, 22 consisting of nothing more than round pipes which may be welded to or otherwise conventionally attached to the side runners 16, 18. The respective side runners 16, 18 are provided with outwardly extending flanged edges 24, 26, respectively, thereby to present a surface engaging portion which may be conveniently and efficiently drug across a surface upon which a spreading or grading operation is being performed. Further, the side runners 16, 18 are respectively provided with curved end portions 28, 30 which are effectively a part of the respective outwardly extending flanged edges 24, 26 and which further facilitate the movement of the spreader/grader 10 across a surface.

Also positioned between the side runners 16, 18 is a pair of curved cutting blades 32, 34, such blades being operably mounted and relatively movable to the side runners by means of a hydraulic ram adjustment mechanism 36. In this respect, two hydraulic ram adjustment mechanisms 36 are utilized with each cutting blade 32, 34 whereby each end of the respective cutting blades are connected to the respective side runners 16, 18 by one hydraulic ram adjustment mechanism. It is to be understood that if desired and as illustrated in FIG. 1, only one cutting blade 34 might be provided with a hydraulic ram adjustment mechanism 36 while the other blade 32 might be fixedly attached to the spreader/grader 10. Alternatively, the cutting blade 32 might be adjustable by means of a mechanical linkage (not shown) or might be variably positionable through the use of a plurality of apertures provided in the side runners 16, 18 whereby different adjustment angles and cutting depths could be obtained through the use of attachment screws. Of course, the hydraulic ram adjustment mechanism 36 might be utilized in conjunction with cutting blade 32, while cutting blade 34 might be fixedly attached or mechanically movable relative to the side runners 16, 18 as aforedescribed. Therefore, the hydraulic ram adjustment mechanism 36 has been illustrated as attached to but one cutting blade, but it is to be understood that the preferred embodiment of the present invention would probably utilize these hydraulic ram adjustment mechanisms on all of the cutting blades so as to increase the versatility of the spreader/grader 10.

With respect to the three-point hitch 12 illustrated, it is to be understood that this hitch is of a conventional construction and is well-known in the art. In this regard, the three-point hitch 12 includes a topmost extending member 38 and a pair of side extending members 40, 42, all of which are paralleledly aligned and spaced-apart from each other and which are pivotally attached to the tractor 14. The topmost extending member 38 is pivotally connected at one end thereof to the tractor 14 at a connection point 44 and is similarly pivotally connected at its other end to a downwardly extending member 46 at a pivotal connection point 48. Similarly, the side extending members 40, 42 are each pivotally attached to the tractor 14 at one end thereof, only member 42 being shown pivotally attached at connection point 50 in FIG. 1, and are further interconnected with the topmost extending member 38 through connection therewith by a pair of upwardly extending bent side arms 52, 54. The side arms 52, 54 are respectively pivotally attached to the side extending members 40, 42, only one such connection point 56 being shown, and are further attached to the downwardly extending member 46 and the topmost extending member 38 at pivotal connection point 48. Further, the remaining free ends of the side arms 52, 54 are pivotally attached at points 58, 60, respectively, to a pair of outwardly directed extensions 62, 64 which are fixedly attached to and form an integral part of the spreader/grader support member 22. In this regard, it can then be seen that the three-point hitch 12 is attached to the spreader/grader 10 by means of the side arms 52, 54 pivotally attached at points 58, 60, respectively, and the downwardly extending member 46 fixedly attached at point 66 on the support member 20.

The operation of the three-point hitch 12 is facilitated through the use of a pair of connection rods 68, 70 which are respectively pivotally attached to the side extending members 40, 42 at connection points 72, 74, and are further pivotally attached at points 76, 78, respectively, to a pair of lift arms 80, 82.

Figure 2:
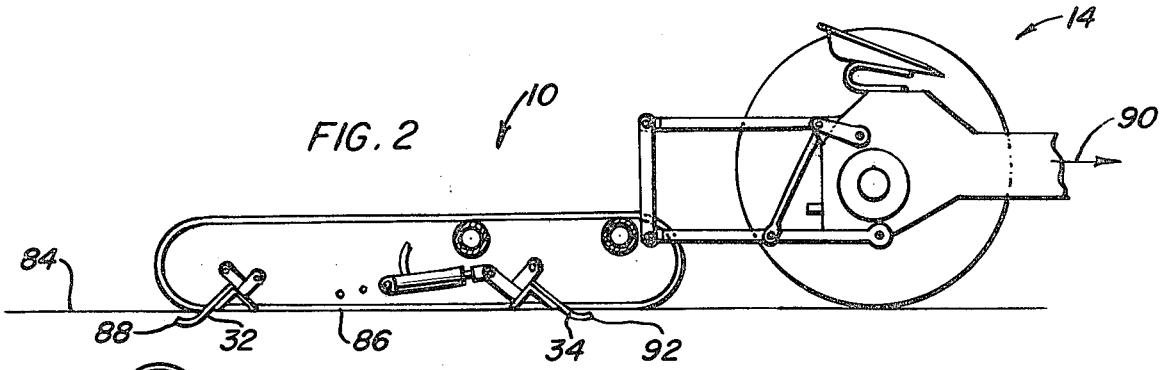
FIG. 2 is a side schematic view of the spreader/grader attached to a three-point hitch and being in an operable position with respective cutting blades being oppositely directed.

Referring now to FIG. 2 of the drawings, it can be seen that the spreader/grader 10 has been lowered to an operative position whereby the tractor 14 may pull the same across a surface 84 so as to effect a desired grading or spreading operation. In this connection, the respective cutting blades 32, 34 are shown positioned at a depth extending below a bottom edge 86 of the respective side runners 16, 18 to thereby extend for some depth below the surface 84. In the particular configuration illustrated in FIG. 2, it can be seen that the curved cutting blade 32 has its curved cutting edge 88 extending in a rearwardly direction away from the direction of tow as indicated by the arrow 90. By the same token, the curved cutting blade 34 has its curved cutting edge 92 directed towards the direction of tow 90. As such, the cutting blade 34 will effectively cut or dig into the surface 84 at a desired depth, while the cutting blade 32 may be similarly positioned at a desired depth and will serve to smooth or grade the surface and to break up clods or chunks of surface material.

Figure 3:
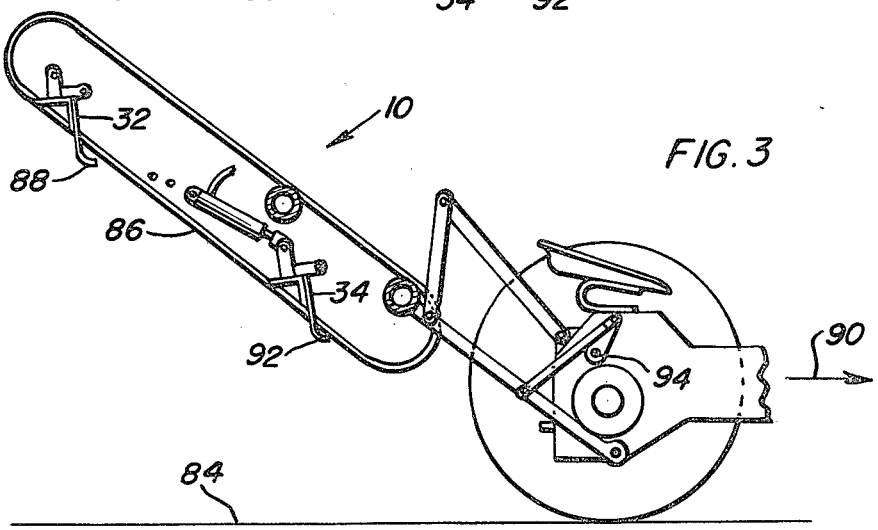
FIG. 3 is a side schematic view of the present invention showing the same in a retracted non-operable position and having the cutting blades both directed in the same cutting direction.

With reference to FIG. 3, the spreader/grader 10 is shown in an elevated or non-operative position obtained as a result of the lift arms 80, 82 being hydraulically rotated about a pivot axis 94 to thereby lift the three-point hitch 12 in the manner illustrated. In this connection, an appreciation can be had for all of the pivotal connections associated with the three-point hitch 12, such pivotal connection points being required to effectively raise and lower the spreader/grader 10. Further illustrated in FIG. 3 is the fact that the cutting blade 32 may be removed and re-attached to the spreader/grader 10 so as to position the cutting edge 88 in a direction toward the tow direction 90. This reversibility of the cutting blade 32, as well as the cutting blade 34, permits an operator to optionally use both blades simultaneously in a cutting relationship or in a grading or smoothing relation or, if desired, in the manner illustrated in FIG. 2 wherein one blade is in a cutting position and the other is in a grading or smoothing position.

Figure 4:
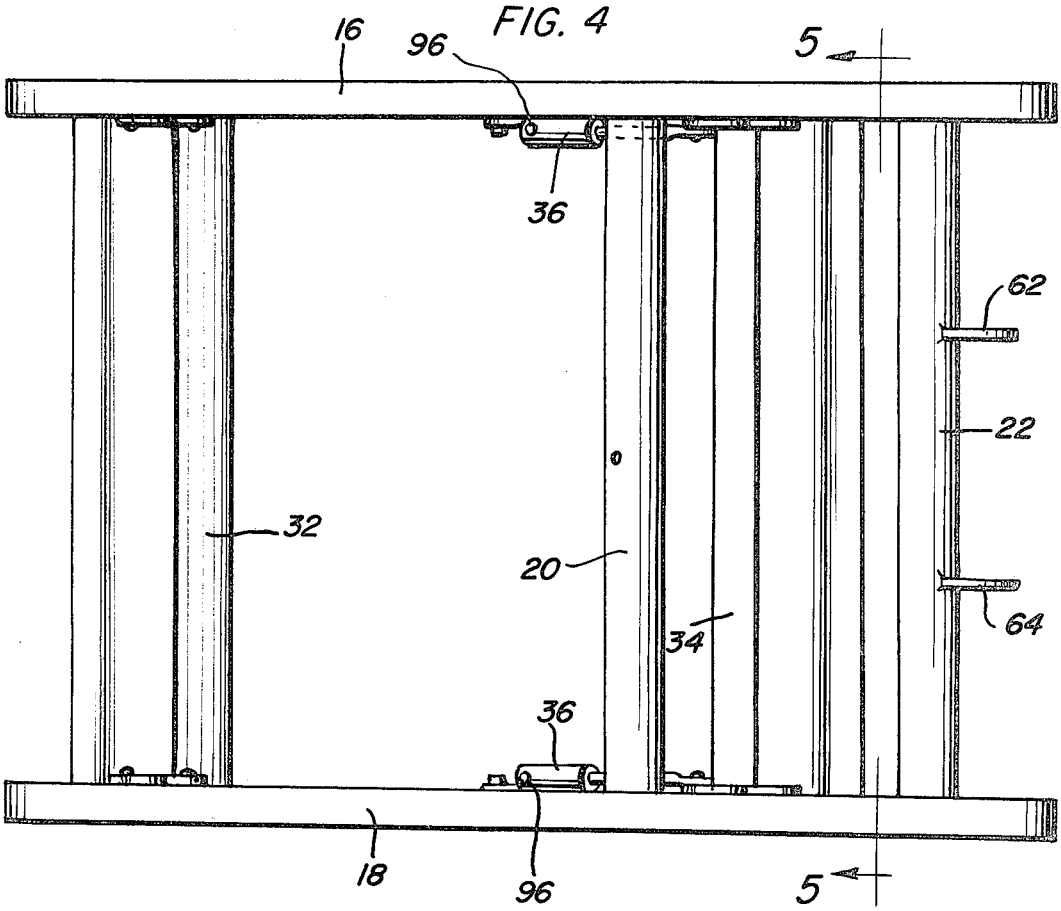
FIG. 4 is a top plan view of the spreader/grader illustrated in FIG. 1.

FIG. 4 is provided to illustrate the top structural arrangement of the spreader/grader 10, and to more particularly point out the fact that a pair of hydraulic ram adjustment mechanisms 36 may be utilized with each cutting blade 32, 34. In this regard, the hydraulic ram adjustment mechanisms 36 are each provided with a connection nipple 96 to which may be attached a hydraulic line (not shown) for remote operation, preferably by the tractor operator, so as to effect the desired angle and depth adjustment of the respective cutting blades 32, 34. Again, it is pointed out that although only one set of hydraulic ram adjustment mechanisms 36 are shown in operable relationship with the cutting blade 34, the preferred embodiment of the present invention envisions utilizing a similar set of hydraulic ram adjustment mechanisms for operation of the rearward cutting blade 32.

Figure 5:
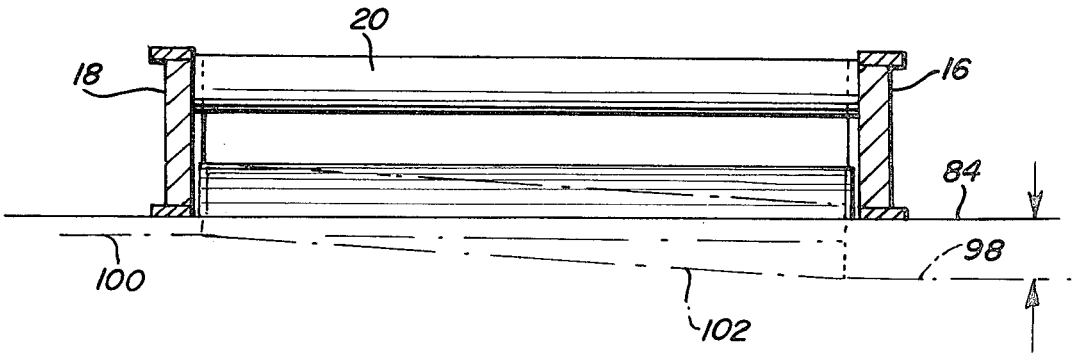
FIG. 5 is a cross-sectional view taken along the line 5—5 of FIG. 4.

FIG. 5, which is a cross section of the spreader/grader 10 taken along the line 5—5 of FIG. 4, further illustrates adjustment of one end of the cutting blade 34 to a depth 98 below the surface 84 and adjustment of the other end of the cutting blade 34 to a depth 100 below the surface 84. As such, a towing of the spreader/grader 10 across the surface 84 will result in a cutting or grading thereof so as to define a new surface represented by the broken line 102. This angular adjustment of the respective cutting blades 32, 34 permits a desired contouring of a surface area, as well as a means of operably moving the spreader/grader 10 in an efficient manner across various land contours or terrain.

Figure 6:
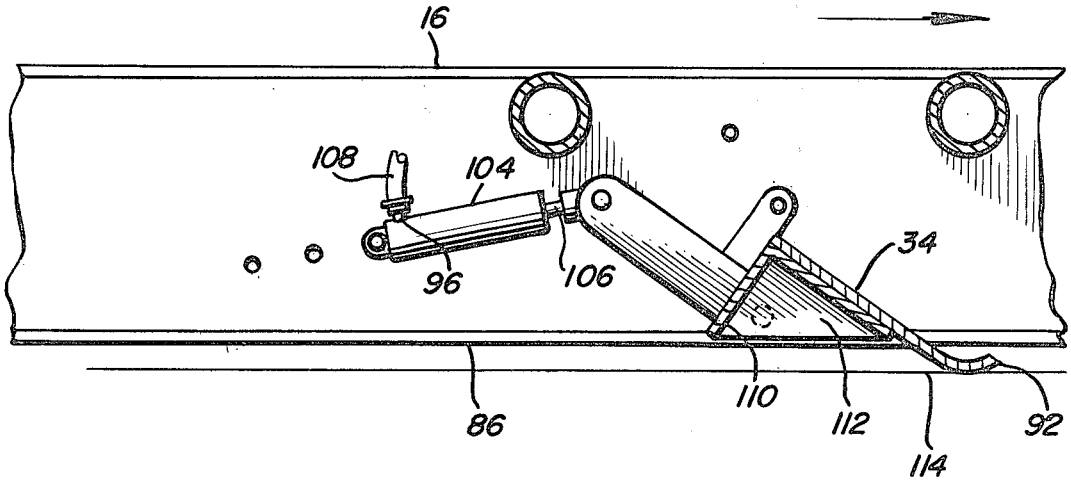
FIG. 6 is a detailed structural view of the hydraulic ram adjustment mechanism utilized to vary the surface contact angle and depth of a cutting blade.

FIG. 6 further illustrates the versatility afforded by the hydraulic ram adjustment mechanism 36 in controlling the angular relationship and depth adjustment of the cutting blades 32, 34. As illustrated, a typical hydraulic ram adjustment mechanism 36 includes a hydraulic cylinder 104 having a fluidic chamber therein and a piston 106 reciprocable within the hydraulic cylinder in response to an input or discharge of fluid through a fluid connection conduit 108. In this respect, the fluid connection conduit 108 is connected to the hydraulic connection nipple 96 thereby to establish a fluidic connection between the hydraulic cylinder 104 and a remote point of actuation operably controlled by a tractor operator. This remote control of the fluid directed to the hydraulic ram adjustment mechanism 36 is of a conventional construction and forms no part of the present invention, In this respect, all tractors are provided with a number of hydraulic actuation lines, such as utilized to lift the three-point hitch 12 illustrated in FIG. 3, so that the attachment of fluid attachment conduit 108 to a selectively operable hydraulic circuit is well within the ability of one with ordinary skill in the art.

The cutting blade 34 is shown fixedly attached to an angle bar 110 thereby to afford additional structural support thereto, and the angle bar 110 has a plurality of triangular supports 112 fixedly attached between respective side walls of the angle bar so as to add even a further strengthening effect and support to the cutting blade 34. With respect to the position of the blade 34 as shown in FIG. 6, it can be seen that the piston 106 is in a retracted position within the hydraulic cylinder 104 so as to position the cutting edge 92 at a depth 114 below the bottom surface 86 of a side rail 16.

Figure 7:
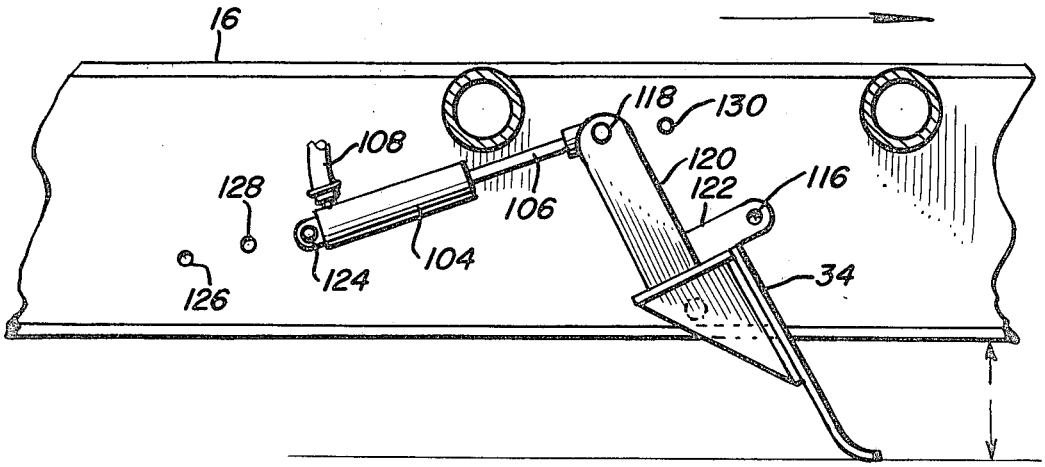
FIG. 7 is a detailed structural view of the hydraulic ram adjustment mechanism shown in an extended position so as to increase the depth of cut of a cutting blade.

As illustrated in FIG. 7, the piston 106 may be extended from the hydraulic cylinder 104 through an insertion of fluid through the fluid connection conduit 108 thereby to cause a pivoting of the cutting blade 34 about a point of pivotal attachment 116 between the blade and the side runner 16. In this regard, the cutting blade 34 is pivotally attached to the piston 106 at a pivotal connection point 118 established between the piston and an upwardly extending arm 120 fixedly secured to the cutting blade. As such, the cutting blade 34 is retained in engagement with the side runner 16 by means of the pivotal connection 116 provided in sidewardly extending arm 122 fixedly attached to the cutting blade. A pivotal connection 118 operably attaches the blade 34 to the hydraulic ram adjustment mechanism 36 which is in turn pivotally attached to the side runner 16 at a pivotal connection point 124. A similar connection is provided at the other unshown end of the cutting blade 34 which is located proximate to side runner 18. Similarly, the same attachment arrangement may be provided for cutting blade 32.

FIG. 7 further illustrates the added versatility for adjustment of blade angle and depth through the provision of a plurality of apertures 126, 128 whereby the adjustment mechanism 36 might be disconnected from the connection point 124 and pivotally reconnected in either of the apertures 126, 128. Such a positioning of course effects the angular relationship of the cutting blade 34 as it extends from a bottom portion of the spreader/grader 10. An even further control of the angular relationship of the blade 34 to the spreader/grader 10 can be achieved by utilizing additional pivotal connection points, such as connection point 130 whereby the cutting blade 34 could be disconnected from the connection point 116 and pivotally mounted in the aperture 130, thereby to further effect depth and angle relationships. As such, it should be understood that any number of apertures could be provided through which the hydraulic ram adjustment mechanism might be pivotally mounted or the cutting blades 32, 34 might be pivotally mounted so as to provide a substantial number of angle and depth adjustments for the individual cutting blades.

In operation, it can be appreciated that the spreader/grader 10 may be attached to a tractor 14, or other towing vehicle, by any conventional three-point hitch 12. As described above, both cutting blades 32, 34 may be positioned between the side runners 16, 18 so as to present their respective cutting edges 88, 92 in a direction aligned with the direction of tow whereby to present two cutting blades in engagement with a surface. While this configuration is specifically shown in FIG. 3 of the drawings, one or both of the cutting blades 32, 34 may be also reversed in position so as to position their respective cutting edges 88, 92 in a direction opposite to that of the direction of tow, as illustrated in FIG. 2. Depending upon the type of grading or spreading work to be undertaken, the respective blades 32, 34 may be angularly adjusted in a manner illustrated in FIG. 5 so as to achieve a deeper surface cut next to one side runner 16 or 18 as opposed to the other side runner. Further, depending on the type of operation to be performed, it can be appreciated that the angle and depth of cut afforded by a cutting blade 32, 34 can be even further adjusted by mounting the hydraulic ram adjustment mechanism 36 in any one of a plurality of apertures provided on a respective side runner 16, 18 and similarly by pivotally mounting the cutting blades in any one of a plurality of apertures so provided.

The construction of the spreader/grader 10 as above discussed is designed so as to maximize performance while utilizing a minimum amount of horsepower and fuel consumption. Unlike the land levelers utilized in the prior art, the spreader/grader of the present invention is designed to grade forward or backward with both blades being visible to the operator at all times. Of course, it is to be realized that optimum dimensional relationships for the parts of the invention are deemed readily apparent and obvious to one skilled in the art, and all equivalent relationships to those illustrated in the drawings and described in the specification are intended to be encompassed by the invention, subject only to limitations specifically appearing in the claims. As such, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A spreader/grader for attachment to and vertical manipulation by a tractor and the like having a three-point hitch for performing a spreading and grading operation upon a surface, said spreader/grader comprising:

a frame connectible to the three-point hitch of the towing tractor to enable lifting of the frame at the end of a sweep across the surface and subsequent lowering to an operative position a first blade operably attached to said frame;

a second blade operably attached to said frame; and first adjustment means for varying the angular relationship of said first blade with said frame, said first and second blades being transversely continuous and supported for pivotal adjustment about an axis transverse to the frame.

2. The spreader/grader as defined in claim 1, wherein a second adjustment means is provided for varying a cutting depth and an angular reltionship of said second cutting means with said frame.

3. The spreader/grader as defined in claim 1, wherein said first adjustment means comprises a hydraulic ram adjustment mechanism, said hydraulic ram adjustment mechanism being pivotally attached at one end thereof to said frame and at another end thereof to said first blade whereby said adjustment mechanism may be actuated to pivot said first blade means about a transverse axis thereby to adjust a cutting depth afforded by said spreader/grader by varying the angle of the first blade.

4. A spreader/grader comprising a frame defined by a pair of parallel ground engaging runners rigidly interconnected by transverse frame means, a front blade mounted between said runners and being transversely continuous, a rear blade mounted between said runners and being transversely continuous, means interconnecting said blades and said runners to vary the relative position of the blades and runners and reverse the blades to enable the blades to grade, spread and transport dirt when moving in a forward or rearward direction, a tractor with a powered three-point hitch, and means on said frame connected with the three-point hitch to enable vertical manipulation of the grader/spreader for dumping dirt from the blades, elevating the frame and blades to facilitate turn around at the end of a sweep across a surface and enabling the frame to be positioned in an inclined position for grading a slope.

5. The combination as defined in claim 4, wherein said means interconnecting the blades and runners includes a pivotal connection between the ends of the blades and runners and hydraulic ram means interconnecting the blades and runners in spaced relation to the pivotal connection to vary the angle of the blades about a transverse axis and vary the distance the lower edge of the blades project below the lower edge of the runners, the point of pivotal connection between the ends of the blades and runners being oriented at selective vertical positions to enable the bottom edge of the blades to be inclined transversely of the frame.

* * * * *